US011713522B2

(12) United States Patent
Ellis

(10) Patent No.: US 11,713,522 B2
(45) Date of Patent: Aug. 1, 2023

(54) WOVEN FABRIC WITH HOLLOW CHANNEL FOR PREVENTION OF STRUCTURAL DAMAGE TO FUNCTIONAL YARN, MONOFILAMENT YARN, OR WIRE CONTAINED THEREIN

(71) Applicant: Inman Mills, Inman, SC (US)

(72) Inventor: Thomas M. Ellis, Seneca, SC (US)

(73) Assignee: Inman Mills, Inman, SC (US)

( * ) Notice: Subject to any disclaimer, the term of this patent is extended or adjusted under 35 U.S.C. 154(b) by 450 days.

(21) Appl. No.: 16/563,030

(22) Filed: Sep. 6, 2019

(65) Prior Publication Data

US 2020/0080240 A1 Mar. 12, 2020

Related U.S. Application Data

(60) Provisional application No. 62/730,028, filed on Sep. 12, 2018, provisional application No. 62/820,430, filed on Mar. 19, 2019.

(51) Int. Cl.
*D03D 11/02* (2006.01)
*D03D 13/00* (2006.01)
(Continued)

(52) U.S. Cl.
CPC ..... *D03D 11/02* (2013.01); *D03D 1/0043* (2021.05); *D03D 1/0088* (2013.01); *D03D 3/02* (2013.01);
(Continued)

(58) Field of Classification Search
CPC .... D03D 11/02; D03D 1/0043; D03D 1/0088; D03D 3/02; D03D 13/004;
(Continued)

(56) References Cited

U.S. PATENT DOCUMENTS 3,038,365 A * 6/1962 Peterson ..... G10H 1/057 84/686
3,490,224 A * 1/1970 Bourgeas ..... H01B 7/182 57/210
(Continued)

FOREIGN PATENT DOCUMENTS

EP 1 777 336 A2 4/2007
JP 2018131112 A 8/2018
WO WO 2018/115726 A1 6/2018

OTHER PUBLICATIONS

International Search Report and Written Opinion for PCT/US2019/049905, dated Nov. 18, 2019, 15 pages.

*Primary Examiner* — Robert H Muromoto, Jr.
(74) *Attorney, Agent, or Firm* — Dority & Manning, P.A.

(57) ABSTRACT

A fabric substrate having a warp direction and a fill direction is provided. The fabric substrate includes a plurality of warp yarns, a plurality of fill yarns. A portion of the plurality of the fill yarns form a hollow channel extending in the fill direction, and the hollow channel contains an encased fill yarn. As such, the encased fill yarn is protected from abrasion, bending, flexing, folding, compression, shrinkage, or expansion of the fabric substrate and remains undamaged after the fabric substrate is woven and subsequently handled or processed. In other embodiments, a hollow channel containing an encased yarn is formed in the warp direction, or hollow channels each containing an encased yarn are formed in both the fill direction and the warp direction.

40 Claims, 7 Drawing Sheets

(51) Int. Cl.
*D03D 1/00* (2006.01)
*D03D 3/02* (2006.01)
*D03D 25/00* (2006.01)

(52) U.S. Cl.
CPC ..... *D03D 13/004* (2013.01); *D10B 2403/03* (2013.01)

(58) Field of Classification Search
CPC ..... D10B 2403/03; D10B 2401/18; D10B 2403/024; D10B 2501/00
See application file for complete search history.

(56) References Cited

U.S. PATENT DOCUMENTS 4,107,909 A * 8/1978 Fehrer ..... D01H 4/16 57/5
4,154,881 A * 5/1979 Hirakawa ..... D02G 3/445 428/92
4,228,829 A * 10/1980 Kikuchi ..... D03D 11/02 139/408
4,384,449 A * 5/1983 Byrnes, Sr. ..... A41D 19/01511 139/425 R
4,793,130 A * 12/1988 Togashi ..... D02G 3/12 57/210
4,921,756 A * 5/1990 Tolbert ..... D02G 3/367 428/373
4,926,910 A * 5/1990 Wade ..... D02G 3/12 139/425 R
4,927,698 A * 5/1990 Jaco ..... D02G 3/38 428/198
5,033,262 A * 7/1991 Montgomery ..... D03D 15/513 57/5
5,540,980 A * 7/1996 Tolbert ..... D02G 3/36 428/215
5,568,719 A * 10/1996 Proctor ..... D02G 3/367 57/12
5,617,713 A * 4/1997 Mawick ..... D02G 3/12 57/210
5,910,361 A * 6/1999 Guevel ..... D02G 3/385 428/364
5,927,060 A * 7/1999 Watson ..... D02G 3/38 57/210
6,032,450 A * 3/2000 Blum ..... D02G 3/12 57/75
6,287,686 B1 * 9/2001 Huang ..... D02G 3/443 428/362
6,287,690 B1 * 9/2001 Land ..... D03D 15/513 428/370
6,410,140 B1 * 6/2002 Land ..... D02G 3/443 428/377
6,467,251 B1 * 10/2002 Kolmes ..... D02G 3/185 57/230
6,553,749 B2 * 4/2003 Land ..... D03D 15/513 57/5
6,655,122 B2 * 12/2003 Shigeyama ..... D01H 4/02 57/5
6,764,764 B1 * 7/2004 Tam ..... D01F 6/04 428/364
7,100,352 B2 * 9/2006 Robins ..... D02G 3/38 57/210
7,144,830 B2 * 12/2006 Hill ..... H05K 1/189 442/205
7,592,276 B2 * 9/2009 Hill ..... D03D 15/258 442/301
7,682,997 B2 * 3/2010 Altman ..... B32B 17/02 442/397
7,718,259 B2 * 5/2010 Pollet ..... D02G 3/36 428/357
7,776,770 B2 * 8/2010 Wang ..... B29C 43/021 442/306
7,841,162 B2 * 11/2010 Coombs ..... D02G 3/38 57/210
8,093,160 B2 * 1/2012 Tharpe, Jr. ..... D02G 3/328 442/191
8,720,174 B2 * 5/2014 Kochmann ..... D02G 3/367 57/5
9,637,843 B2 * 5/2017 Kunisada ..... D02G 3/441
10,053,801 B2 * 8/2018 Hightower, III ..... D02G 1/0286
11,035,058 B2 * 6/2021 Hightower, III ..... D03D 15/47
2004/0002272 A1 * 1/2004 Land ..... D02G 3/36 442/190
2007/0049148 A1 * 3/2007 Chien ..... B29C 70/465 442/190
2010/0197184 A1 * 8/2010 Browne ..... B60J 7/104 442/229
2010/0239856 A1 * 9/2010 Olson ..... B32B 5/022 428/339
2012/0077397 A1 * 3/2012 Porter ..... D02G 3/16 442/51
2012/0137649 A1 * 6/2012 Kochmann ..... D02G 3/367 57/211
2012/0220179 A1 * 8/2012 Nakase ..... D02G 3/04 442/181
2013/0040523 A1 * 2/2013 Takahashi ..... D02G 3/28 442/190
2017/0275789 A1 * 9/2017 Dias ..... D02G 3/22
2020/0193251 A1 * 6/2020 Ellis ..... G05B 19/4097

* cited by examiner

WOVEN FABRIC WITH HOLLOW CHANNEL FOR PREVENTION OF STRUCTURAL DAMAGE TO FUNCTIONAL YARN, MONOFILAMENT YARN, OR WIRE CONTAINED THEREIN

RELATED APPLICATIONS

The present application claims priority to U.S. Provisional Application Ser. No. 62/730,028, filed on Sep. 12, 2018 and U.S. Provisional Application Ser. No. 62/820,430, filed on Mar. 19, 2019, both of which are incorporated herein in their entirety by reference thereto.

BACKGROUND

In recent years, there has been rapidly increasing interest in making a full range of textile products that have added functionality, past providing normal cover, comfort, aesthetics, and the conventional or ordinary performance. This added functionality might include examples such as higher visibility, the ability to generate and store electrical power, color change at will, the ability to communicate wirelessly, and the ability to store user information. In order to realize textiles that have improved functionality, it is inherent that advances will be required at the molecular level, the fiber level, the yarn level, and the fabric formation level. At the present stage of technical development, most researchers are focused at the fiber or yarn level.

Therefore, with the advancement of miniaturized electronic components and new polymer chemistries, attempts have been made to incorporate functional fibers and yarns (such as materials that include light emitting diodes (LEDs), photonics, batteries, or other chemical or electronic components) into fabrics to enhance their overall functionality and value. However, one problem with incorporating functional yarns into textile fabrics is that, in general, functional yarns and fibers are physically quite dissimilar from conventional textile yarns and fibers such as cotton and polyester. When these dissimilar materials are incorporated into the same fabric, undesired consequences can result such as differential shrinkage, waviness, puckering, and unwanted textures. Textile fabrics tend to contract during the weaving or knitting process. This contraction, in turn, leads to kinking, bending, and/or breakage of one or more sections of the functional yarn incorporated into the fabric, as the functional yarns (as they exist today) tend to have an increased stiffness or brittleness compared to other conventional yarns in the fabric. As a result of this difference in stiffness or brittleness, the functional yarn can be damaged and no longer useful for its intended advantage. For example, in the case of a functional yarn containing an LED component, the functional yarn would no longer be able to emit light. Similar damage can also occur when stiffer wires or monofilaments are incorporated into fabrics containing conventional yarns in order to achieve a desired property for the fabric.

Thus, a need exists for a woven fabric construction that, by design, is inherently capable of preventing any type of damage to a yarn (e.g., a functional yarn, monofilament yarn, wire, etc.) incorporated therein.

SUMMARY

In one particular embodiment, the present disclosure is directed to a fabric substrate having a warp direction and a fill direction. The fabric substrate includes a plurality of warp yarns and a plurality of fill yarns. Further, a portion of the plurality of the fill yarns form a hollow channel extending in the fill direction, and the hollow channel contains an encased fill yarn.

In one embodiment, the encased fill yarn can include a functional yarn, a monofilament yarn, or a wire. For instance, the functional yarn can contain a functional or electronic component, or functional chemistry. Further, the functional or electronic component can include a photonic device, a battery, light emitting diode, or a combination thereof. Meanwhile, the monofilament can be nylon, polyethylene, ultrahigh molecular weight polyethylene, polyvinylidene fluoride, polyester, or a combination thereof, and the wire can include a metal.

In another embodiment, the encased fill yarn can have a diameter ranging from about 0.15 millimeters to about 1.25 millimeters.

In yet another embodiment, a ratio of a diameter of the hollow channel to a diameter of the encased fill yarn can range from about 1.01 to about 20.

In still another embodiment, the plurality of fill yarns can each have a diameter ranging from about 0.05 millimeters to about 1 millimeter.

In one more embodiment, the plurality of fill yarns can each include non-aromatic polyamide fibers, polyester fibers, polyolefin fibers, cotton fibers, or a combination thereof.

In an additional embodiment, the portion of the plurality of fill yarns forming the hollow channel can include from 3 yarns to 30 yarns.

In another embodiment, the fabric substrate can include at least one additional hollow channel adjacent the hollow channel. Further, the at least one additional hollow channel can contain an additional encased yarn, which can be formed from the same materials as the encased fill yarn. In addition, the hollow channel and the at least on additional hollow channel can be separated by a distance in the warp direction ranging from about 2.5 millimeters to about 200 millimeters.

In yet another embodiment, the plurality of warp yarns can each have a diameter ranging from about 0.05 millimeters to about 1 millimeter. Further, each of the plurality of warp yarns can include a sheath and a core. For example, the sheath can include non-aromatic polyamide fibers, polyester fibers, polyolefin fibers, cotton fibers, or a combination thereof, while the core can include a glass filament, a monofilament, carbon fibers, or polyester fibers.

In still another embodiment, a portion of the plurality of the warp yarns form a hollow channel extending in the warp direction, wherein the hollow channel contains an encased warp yarn.

In another embodiment, the present disclosure is directed to a fabric substrate having a warp direction and a fill direction. The fabric substrate includes a plurality of warp yarns and a plurality of fill yarns. Further, a portion of the plurality of the warp yarns form a hollow channel extending in the warp direction, and the hollow channel contains an encased warp yarn.

In one embodiment, the encased warp yarn can include a functional yarn, a monofilament yarn, or a wire. For instance, the functional yarn can contain a functional or electronic component, or functional chemistry. Further, the functional or electronic component can include a photonic device, a battery, light emitting diode, or a combination thereof. Meanwhile, the monofilament can be nylon, polyethylene, ultrahigh molecular weight polyethylene, polyvinylidene fluoride, polyester, or a combination thereof, and the wire can include a metal.

In another embodiment, the encased warp yarn can have a diameter ranging from about 0.15 millimeters to about 1.25 millimeters.

In yet another embodiment, a ratio of a diameter of the hollow channel to a diameter of the encased warp yarn can range from about 1.01 to about 20.

In still another embodiment, the plurality of fill yarns can each have a diameter ranging from about 0.05 millimeters to about 1 millimeter.

In one more embodiment, the plurality of fill yarns can each include non-aromatic polyamide fibers, polyester fibers, polyolefin fibers, cotton fibers, or a combination thereof.

In an additional embodiment, the portion of the plurality of warp yarns forming the hollow channel can include from 3 yarns to 30 yarns.

In another embodiment, the fabric substrate can include at least one additional hollow channel adjacent the hollow channel. Further, the at least one additional hollow channel can contain an additional encased yarn, which can be formed from the same materials as the encased warp yarn. In addition, the hollow channel and the at least on additional hollow channel can be separated by a distance in the fill direction ranging from about 2.5 millimeters to about 200 millimeters.

In yet another embodiment, the plurality of fill yarns can each have a diameter ranging from about 0.05 millimeters to about 1 millimeter. Further, each of the plurality of fill yarns can include a sheath and a core. For example, the sheath can include non-aromatic polyamide fibers, polyester fibers, polyolefin fibers, cotton fibers, or a combination thereof, while the core can include a glass filament, a monofilament, carbon fibers, or polyester fibers.

In still another embodiment, a portion of the plurality of the fill yarns form a hollow channel extending in the fill direction, wherein the hollow channel contains an encased fill yarn.

In one particular embodiment, a fabric product that includes a fabric substrate as defined according to any of the features above is contemplated. Further, the fabric product can be an item of apparel and/or can be a protective, automotive, industrial, medical, or carpeting product. Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
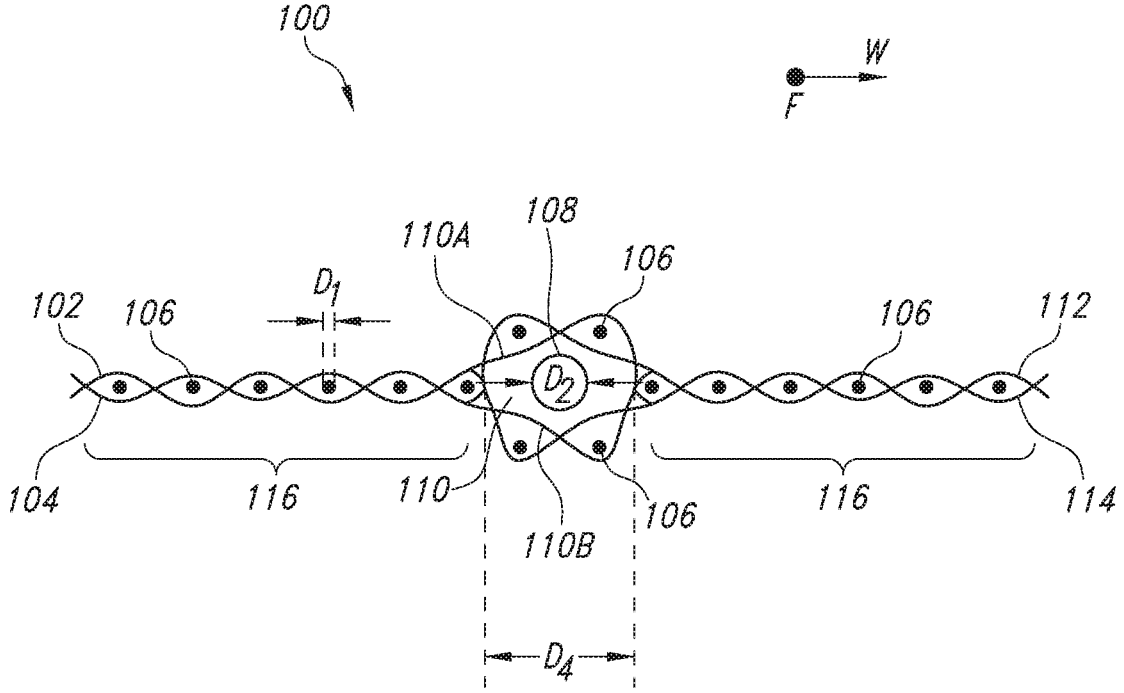
FIG. 1 is a cross-sectional view of a typical embodiment of a fabric substrate made in accordance with the present disclosure taken along the warp direction.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "about," "approximately," or "generally," when used to modify a value, indicates that the value can be raised or lowered by 5% and remain within the disclosed embodiment.

Generally speaking, the present invention is directed to a fabric substrate having a warp direction and a fill or weft direction. The fabric substrate includes a plurality of warp yarns and a plurality of fill or weft yarns. Further, a portion of the plurality of the fill yarns form a hollow channel extending in the fill direction, and the hollow channel contains an encased yarn. As such, the encased yarn, which can be a specialty fiber or yarn, wire, monofilament, or other material that might otherwise be subject to damage if incorporated into a conventional textile fabric, is protected from abrasion, bending, flexing, folding, compression, shrinkage, or expansion and remains undamaged after the fabric substrate is woven and subsequently handled or processed. For instance, the encased yarn can remain undamaged and/or functional after the fabric substrate is woven, even if the fabric material changes dimensions immediately after weaving due to contraction, such as when weaving tensions are released or due to expansion. Further, the dimensions (e.g., diameter) of the hollow channels that are built into the fabric substrate can be closely controlled, as can the distance between the adjacent hollow channels in order to yield a pattern of repeating hollow channels along the warp direction, where each of the hollow channels extends in the fill direction. The present disclosure also contemplates that the hollow channel and the at least one encased yarn can be disposed in the warp direction W, or may be used only in the warp direction W. As part of the automated weaving process, the aforementioned hollow channels can be filled with the encased yarn (e.g., the material to be encased and protected), which can include photonic yarns, LED yarns, monofilament yarns, metallic wires, functional fibers, etc.

Figure 2:
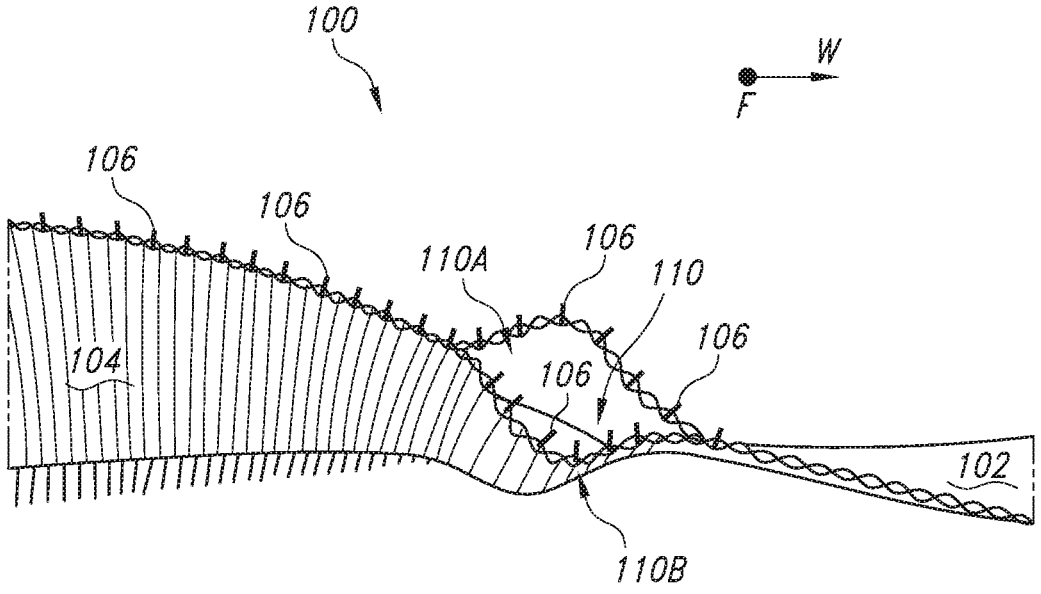
FIG. 2 is a photograph of a cross-sectional view of the fabric substrate that includes a hollow channel for encasing a fill yarn, where the fill yarn is undamaged due to any abrasion, bending, flexing, folding, compression, shrinkage, or expansion of the fabric substrate and remains undamaged after the fabric substrate is woven and subsequently handled or processed.
Figure 3:
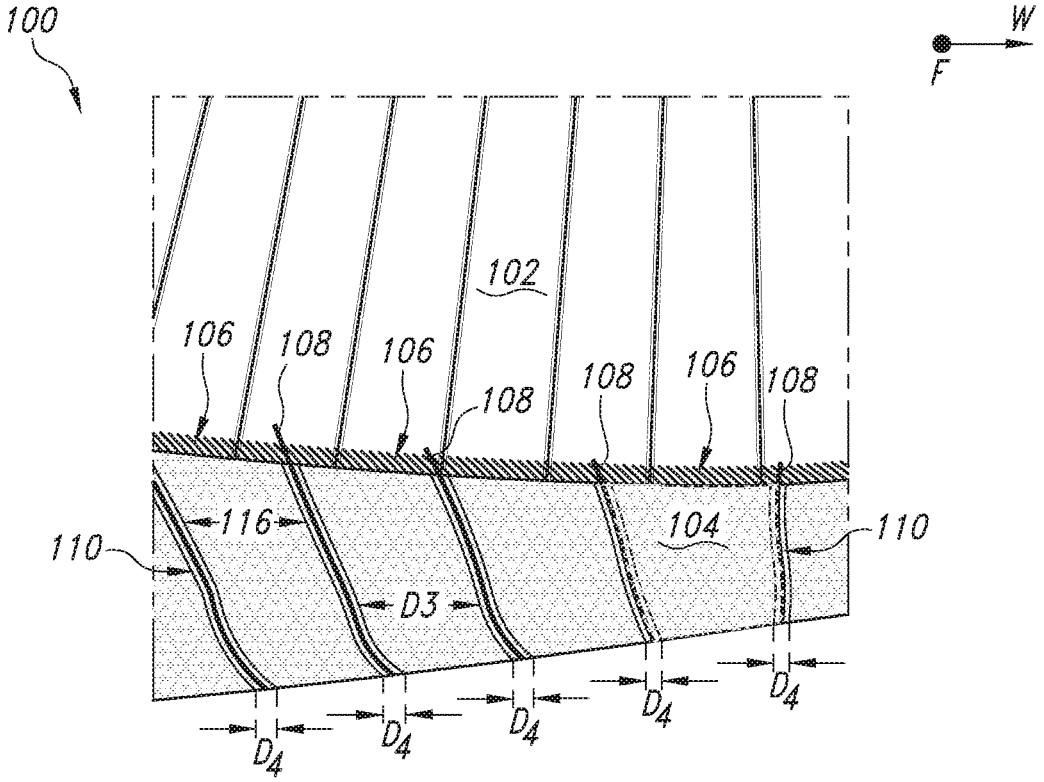
FIG. 3 is an additional photograph of the fabric substrate that includes multiple hollow channels, each for encasing a fill yarn, where the fill yarn within each hollow channel is undamaged due to any abrasion, bending, flexing, folding, compression, shrinkage, or expansion of the fabric substrate and remains undamaged after the fabric substrate is woven and subsequently handled or processed.

More specifically, the particular arrangement and materials selected to form the fabric substrate of the present disclosure results in a fabric substrate where the hollow-channel encased yarn, which is generally more stiff than the other fill yarns or the warp yarns in the fabric substrate, does not bend, kink, or break, where such kinking or breakage could render the encased yarn useless for its intended purpose (e.g., structural support, functionality, etc.). As such, the hollow channel or channels present in the fabric substrate can protect the encased yarn as the portions of the fabric substrate adjacent the hollow channel expand, contract, bend, flex, etc., which, in turn, prevents kinking, breakage, or other damage to the encased yarn within the hollow channel. Referring now to FIGS. 1-3, the specific components of the fabric substrate 100 are described in more detail.

FIG. 1 shows a cross-sectional view of the fabric substrate 100 along the warp direction W. The fabric substrate 100 can be a woven substrate that includes a first surface 102 and a second surface 104. The fabric substrate 100 can include a plurality of fill yarns 106 as well as at least one encased yarn 108 contained within a hollow channel 110 extending in the fill direction F. The hollow channel 110 can be formed from a portion of the plurality of fill yarns 106 to define a first section 110A of the channel at the first surface 102 of the fabric substrate 100 and a second section 1106 of the channel as the second surface 104 of the fabric substrate 100. As shown, the plurality of fill yarns 106 and the at least one encased yarn 108 can be used as the fill or weft yarns in the fill direction F that is transverse to the warp direction W.

Further, a plurality of warp yarns, such as, but not limited to, warp yarns 112 and 114, can travel in the warp direction W to define the first surface 102 and the second surface 104 and support the plurality of fill yarns 106 and the at least one encased yarn 108 in order to hold the shape of the fabric substrate 100. In the particular embodiment shown in FIG. 1, the plurality of warp yarns can include a first warp yarn 112 and a second warp yarn 114 that can be used in a repeating fashion. As also shown in FIG. 1, the at least one encased yarn 108 is a fill/weft yarn, although the present disclosure also contemplates that the at least one encased yarn 108 can also be disposed in the warp direction W, or may be used only in the warp direction W. In other words, the encased yarn 108 may be present in both the fill direction F and the warp direction W of the fabric substrate 100. In addition, it is to be understood that more than one encased yarn 108 can be present in either the fill direction F and/or the warp direction W.

Further, it is to be understood that the present disclosure also contemplates the use of any suitable weaving pattern known in the art such as a "crowfoot" or broken twill, plain, basket, oxford, satin, or twill pattern may be used to form the woven fabric substrate 100 while utilizing the practice of supporting and protecting the encased yarn 108 through use of a hollow channel 110 as described herein.

In some embodiments, such as when the fabric substrate 100 is formed into a wearable product, the first surface 102 of the fabric substrate 100 can be the exterior-facing surface, while the second surface 104 can be the body-facing surface. Further, the fabric substrate 100 can include from about 10 picks per inch to about 100 picks per inch, such as from about 20 picks per inch to about 80 picks per inch, such as from about 30 picks per inch to about 70 picks per inch, where the unit of picks per inch refers to the number of fill or weft threads per inch of the woven fabric substrate 100. In addition, the fabric substrate 100 can include from about 10 ends per inch to about 100 ends per inch, such as from about 20 ends per inch to about 80 ends per inch, such as from about 30 ends per inch to about 70 ends per inch, where the unit of ends per inch refers to the number of warp threads per inch of the woven fabric substrate 100.

Referring to FIGS. 1-3, the various features of the fabric substrate 100 will now be discussed in more detail.

As discussed above, the fabric substrate 100 can include a plurality of conventional textile weft or fill yarns 106 running in the fill or weft direction F. In one embodiment, the plurality of fill yarns 106 can include synthetic fibers, such as non-aromatic polyamide fibers (nylon fibers), polyester fibers, polyolefin fibers such as polypropylene fibers, or a combination thereof. In another embodiment, the plurality of fill yarns 106 can be natural fibers such as cotton fibers. In another embodiment, the plurality of fill yarns 106 can be non-aromatic polyamide fibers, polyester fibers, polyolefin fibers, cotton fibers, or a combination thereof.

Regardless of the particular fibers used to form the plurality of fill yarns 106, the plurality of fill yarns 106 can be selected to provide the desired aesthetics and tactile properties to the fabric substrate 100. In one particular embodiment, the plurality of fill yarns can have a linear density ranging from about 1 cotton count (Ne) to about 40 Ne, such as from about 4 Ne to about 30 Ne, such as from about 8 Ne to about 20 Ne. Further, the plurality of fill yarns can each have a diameter D1 ranging from about 0.05 millimeters (mm) to about 1 mm, such as from about 0.075 mm to about 0.75 mm, such as from about 0.1 mm to about 0.5 mm.

In addition, the fabric substrate 100 also includes at least one encased yarn 108, such as an encased fill yarn 108 as shown in FIGS. 1-3. The encased yarn 108 can be any type of yarn that includes a functional or electronic component or that provides structural or mechanical support to the fabric substrate 100 to achieve the desired properties. When the encased yarn 108 is a functional yarn that includes a functional or electronic component, such components can include a photonic device, a battery, color change, or a combination thereof. In one particular embodiment, the functional or electronic component can include one or more light emitting diodes (LEDs). In another embodiment, the functional component can include functional chemistry (e.g., a component that is capable of undergoing a color change, such as a thermochromic or photochromic component or material). In other embodiments, the encased yarn 108 can include a monofilament, a wire, or a specialty fiber that may need protection from damage as provided via the hollow channel 110. Further, it is to be understood that the encased yarn 108 can have any cross-sectional shape. For instance, in some embodiments, the functional yarn can be circular, oval, rectangular, square, triangular, hexagonal, etc. In one embodiment, the encased yarn 108 can have a diameter D2 ranging from about 0.15 mm to about 1.25 mm, such as from about 0.2 mm to about 1 mm, such as from about 0.25 mm to about 0.75 mm.

Further, because it can include functional or electronic components, or internal connective wires, the encased yarn 108 can be relatively stiff, resembling or even including a commercial monofilament yarn comprised of polyester or nylon. For example, the encased yarn 108 can exhibit a compressive resistance ranging from about 145 grams per square millimeter to about 155 grams per square millimeter, such as about 150 grams per square millimeter. Meanwhile, conventional textile fibers such as cotton that may be used in the plurality of fill yarns 106 can have a compressive resistance ranging from about 2.5 grams per square millimeter to about 10 grams per square millimeter, such as about 5 grams per square millimeter. To quantify compressive resistance, force is measured in grams, to linearly compress a 0.25 inch test specimen of fiber. The force value is then normalized according to the cross sectional area of the material. In the proposed embodiment, textile fill yarn 106 is flexible and easily compressed, while the encased yarn 108 is more resistant to compression. Therefore, if the overall fabric substrate 100 shrinks, expands, or is otherwise deformed, the at least one hollow channel 110 is present to protect the encased yarn 108 from damage that may result since it is typically formed from a stiffer material than the sections 116 of the fabric substrate 100 that are disposed between the hollow channels 110 and contain the plurality of fill yarns 106, as shown in FIG. 3. Specific details of the at least one hollow channel 110 are discussed below.

As described above and as shown in FIGS. 1-3, the hollow channel 110 protects the encased yarn 108 disposed within it and can be formed from a portion of the plurality of fill yarns 106 to define a first section 110A of the channel at the first surface 102 of the fabric substrate 100 and a second section 1106 of the channel as the second surface 104 of the fabric substrate 100. The portion of the plurality of fill yarns 106 used to form the hollow channel 110 having sections 110A and 1106 can range from 3 fill yarns to 30 fill yarns, such as from 4 fill yarns to 25 fill yarns, such as from 5 fill yarns to 20 fill yarns, such as from 6 fill yarns to 15 fill yarns. The diameter D4 of the hollow channel 110 can be controlled such that is just slightly larger than the diameter D2 of the encased yarn 108 that it surrounds, or the diameter D4 can be substantially larger than the diameter D2 of the encased yarn 108 that it surrounds. In other words, the diameter D4 of the hollow channel 110 may be constructed to correspond with the diameter D2 of the encased yarn 108, such that encased yarn 108 is either tightly bound inside the channel 110 or loosely contained within the channel 110. For instance, the ratio of the diameter D4 of the hollow channel 110 to the diameter D2 of the encased yarn 108 can range from about 1.01 to about 20, such as from about 1.05 to about 15, such as from about 1.1 to about 10, such as from about 1.5 to about 5. In some embodiments, the difference in diameter between the hollow channel 110 diameter D4 and the encased yarn 108 diameter D2 is such that the encased yarn 108 is able to slip laterally (e.g., in the warp direction W) in relation to the sections 116 of the fabric substrate 100 that do not include the hollow channels 110 and form the base woven fabric, as shown in FIG. 3. Such intentional slippage of the encased yarn 108 can further protect the encased yarn 108 from damage.

In addition, and referring to FIG. 3, when two or more hollow channels 110 are present in the fabric substrate 100, the portions of the fabric substrate 100 between adjacent hollow channels 110 (e.g., sections 116) can include normal woven textile fabric that is free of the hollow channels 110. Such sections 116 can span a distance D3 that is controlled based on purpose of the encased yarn 108 contained within each of the hollow channels 110. It is also to be understood that in some embodiments, one or more of the hollow channels 110 may not contain an encased yarn 108 and may instead be empty. In any event, the distance D3 between adjacent hollow channels 110 can range from about 2.5 millimeters to about 200 millimeters, such as from about 5 millimeters to about 150 millimeters, such as from about 10 millimeters to about 100 millimeters, such as from about 15 millimeters to about 75 millimeters.

Further, as part of the automated weaving process, the hollow channels 110 may be filled with the material to be encased and protected, such as photonic yarns, LED yarns, monofilament yarns, metallic wires, functional fibers, etc. referred to as the encased yarns 108.

As described above, the fabric substrate 100 can also include a plurality of warp yarns that run along the warp direction W to maintain and hold the plurality of fill yarns 106 and the encased yarn 108 in their proper position within the fabric substrate 100 and that can define a first surface 102 and a second surface 104 of the fabric substrate 100. Although any suitable yarn or combination of yarns may be used for the warp yarns, such as warp yarns 112 and 114 as shown in FIG. 1, in one embodiment, the warp yarns can include a sheath and a core. For instance, the core can include a glass filament, a monofilament, carbon fibers, or polyester fibers, while the sheath can include non-aromatic polyamide fibers, polyester fibers, polyolefin fibers, cotton fibers, or a combination thereof.

Regardless of the particular material or materials used to form the warp yarns 112 and 114 of the fabric substrate 100, the warp yarns can have a linear density ranging from about 1 cotton count (Ne) to about 20 Ne, such as from about 2 Ne to about 15 Ne, such as from about 3 Ne to about 10 Ne. Further, the warp yarns can have a diameter ranging from about 0.05 mm to about 1.25 mm, such as from about 0.075 mm to about 1 mm, such as from about 0.1 mm to about 0.75 mm.

The fabric substrate 100 with the plurality of fill yarns 106 and encased yarn 108 as described above can be used to form a wide variety of textile products such as garments, protective wear, or end uses where the products are comfortable for the wearer despite the inclusion of the encased yarn 108 in the woven fabric, where the encased yarn 108 can be a functional yarn that can, for example, enhance the visibility of the wearer at night or in other situations where visibility is low or where the encased yarn 108 adds a significant performance characteristic that is otherwise unavailable.

In some embodiments, the fabric product can be used to form a protective, automotive, industrial (e.g., belting), construction, roofing, medical, or carpeting product.

In one particular embodiment, the fabric substrates of the present disclosure can be used to make apparel and other garments. Such apparel can include jackets, shirts, coats, pants, bib overalls, gloves, hats, face shields, socks, shoes, boots and the like. The fabric can be used to form an entire article of clothing or can be used to form a certain component or panel of the clothing. For instance, the fabric can be used as leg fabric for a pair of pants. In still another embodiment, the fabric can be used to produce the entire garment.

For exemplary purposes only, various examples of apparel that may be made from the fabric substrate 100 in accordance with the present disclosure are illustrated in FIGS. 4A through 6C.

Figure 4A:
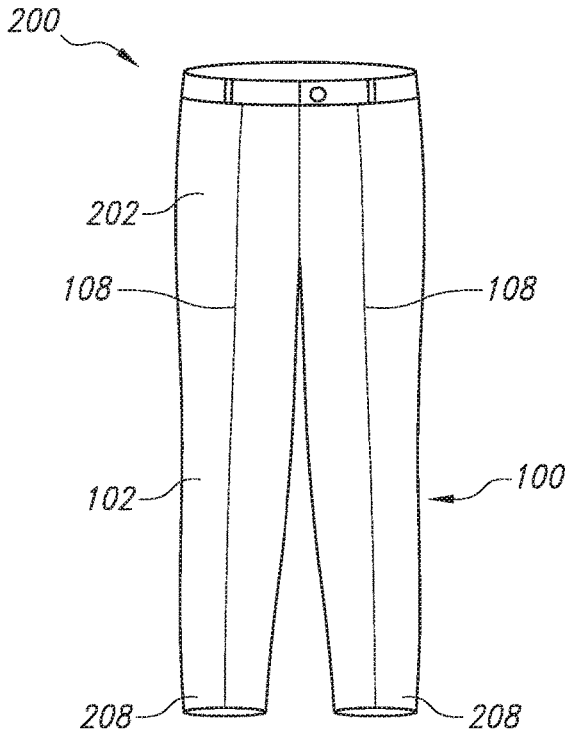
FIG. 4A is a front view of one embodiment of a garment made in accordance with the present disclosure.
Figure 4B:
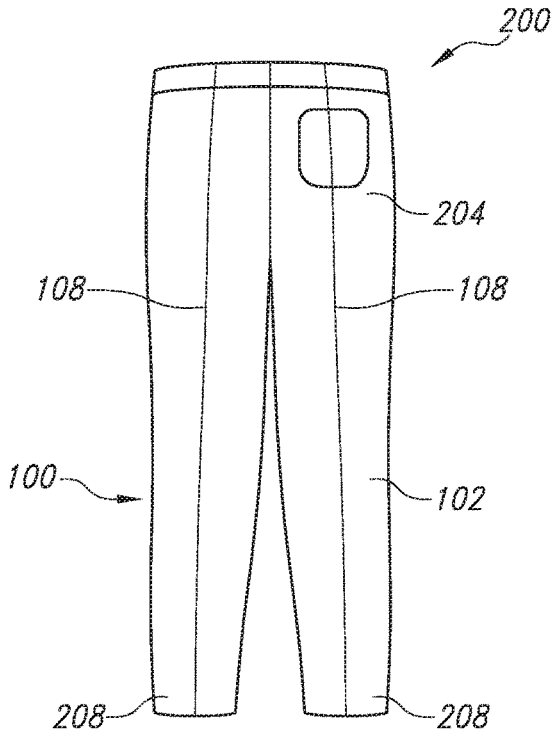
FIG. 4B is a rear view of the garment of FIG. 4A.
Figure 4C:
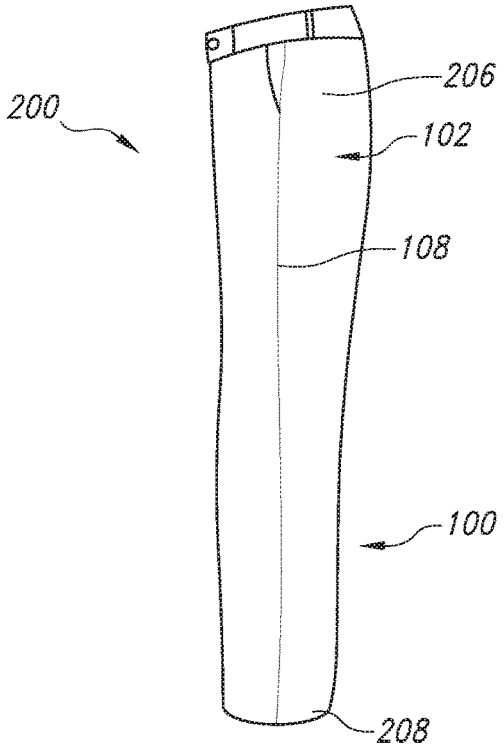
FIG. 4C is a side view of the garment of FIG. 4A.

FIGS. 4A-4C, for instance, illustrate a pair of pants 200. As shown in FIGS. 4A-4C, the pants 200 are formed from the fabric substrate 100 of the present disclosure, where the first surface 102 of the fabric substrate 100 can serve as the exterior-facing surface of the pair of pants 200. The pair of pants 200 can include one or more encased yarns 108. Referring to FIG. 4A, in one embodiment, the one or more encased yarns 108 can be present on the front 202 of the pants 200, such as on one or both pants legs 208. In another embodiment and referring to FIG. 4B, the one or more encased yarns 108 can be present on the back 204 of the pants 200, such as on one or both pants legs 208. In still another embodiment and referring to FIG. 4C, the one or more encased yarns 108 can be present on the side 206 of the pants 200, such as on one or both pants legs 208.

Figure 5A:
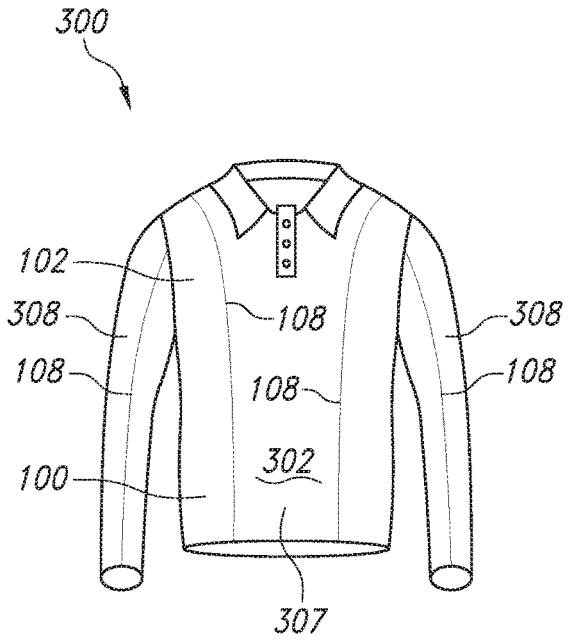
FIG. 5A is a front view of another embodiment of a garment made in accordance with the present disclosure.
Figure 5B:
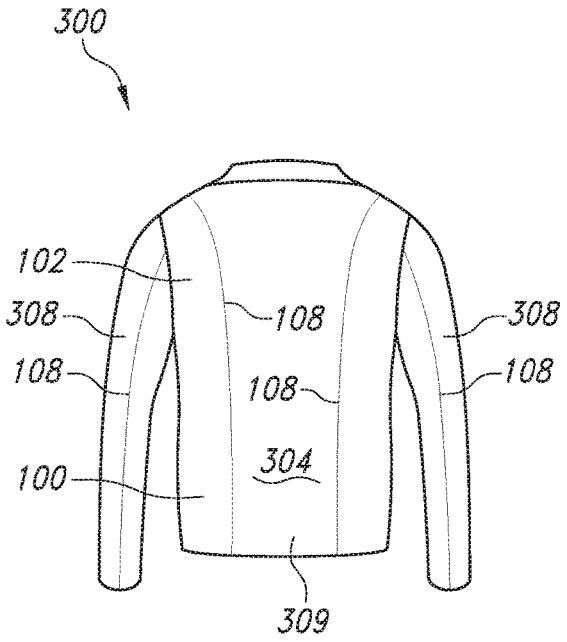
FIG. 5B is a rear view of the garment of FIG. 5A.
Figure 5C:
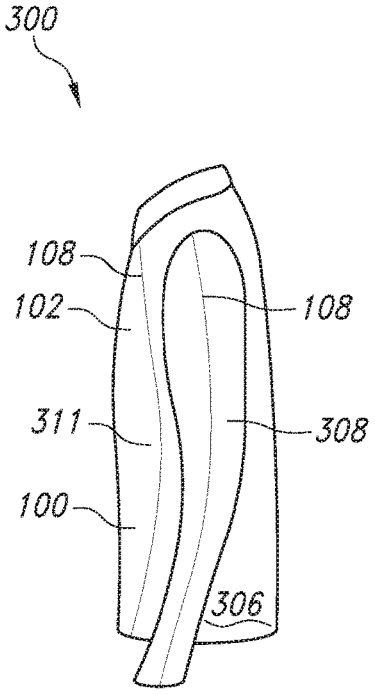
FIG. 5C is a side view of the garment of FIG. 5A.

FIGS. 5A-5C, for example, illustrate a shirt 300. As shown in FIGS. 5A-5C, the shirt 300 is formed from the fabric substrate 100 of the present disclosure, where the first surface 102 of the fabric substrate 100 can serve as the exterior-facing surface of the shirt 300. Referring to FIG. 5A, in one embodiment, the one or more encased yarns 108 can be present on the front 302 of the shirt 300, such as on one or both sleeves 308 and/or on the front panel 307. In another embodiment and referring to FIG. 5B, the one or more encased yarns 108 can be present on the back 304 of the shirt 300, such as on one or both sleeves 308 and/or on the back panel 309. In still another embodiment and referring to FIG. 5C, the one or more encased yarns 108 can be present on the side 306 of the shirt 300, such as on one or both sleeves 308 and/or on a side panel 311.

Figure 6A:
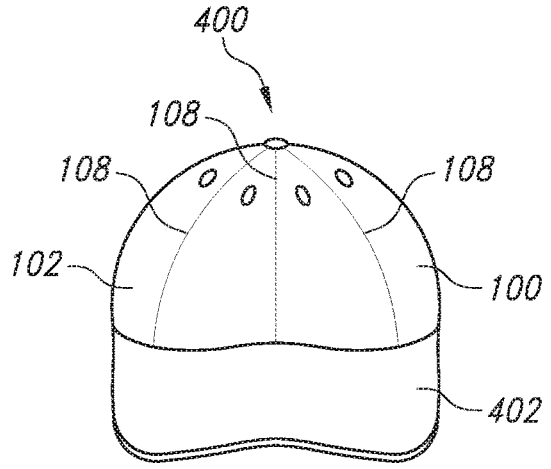
FIG. 6A is a front view of yet another embodiment of a garment made in accordance with the present disclosure.
Figure 6B:
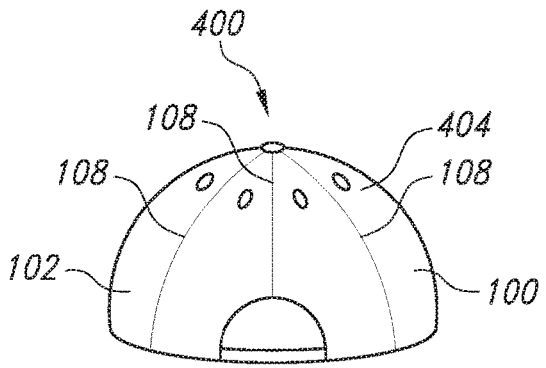
FIG. 6B is a rear view of the garment of FIG. 6A.
Figure 6C:
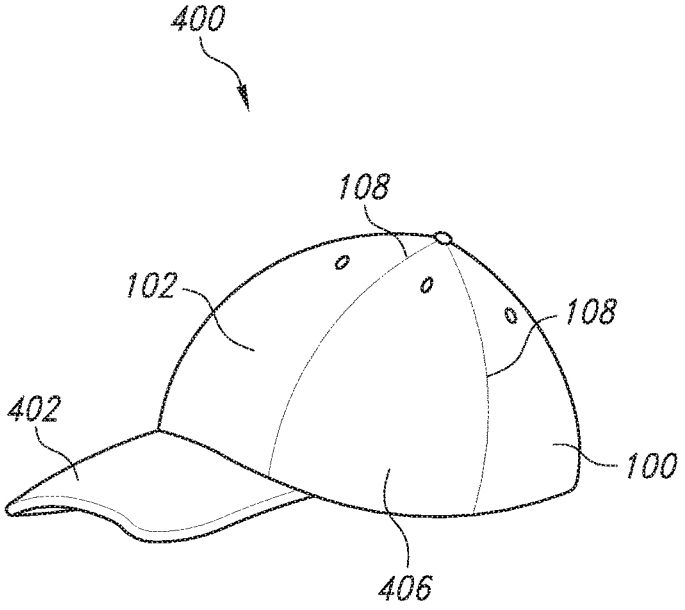
FIG. 6C is a side view of the garment of FIG. 6A.

FIGS. 6A-6C, for instance, illustrate a hat 400. As shown in FIGS. 6A-6C, the hat 400 is formed from the fabric substrate 100 of the present disclosure, where the first surface 102 of the fabric substrate 100 can serve as the exterior-facing surface of the hat 400. Referring to FIG. 6A, in one embodiment, the one or more encased yarns 108 can be present on the front 402 of the hat 400. In another embodiment and referring to FIG. 6B, the one or more encased yarns 108 can be present on the back 404 of the hat. In still another embodiment and referring to FIG. 6C, the one or more encased yarns 108 can be present on the side 406 of the hat 400.

Figure 7:
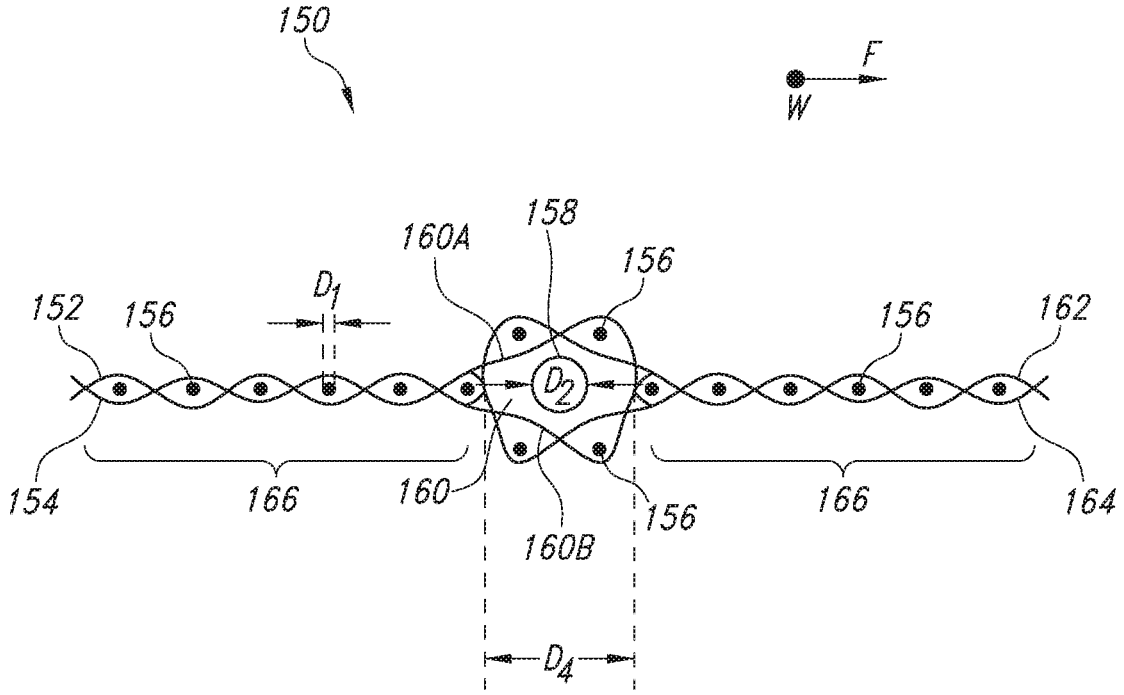
FIG. 7 is a cross-sectional view of an alternative embodiment of a fabric substrate made in accordance with the present disclosure taken along the fill direction.

FIG. 7 illustrates an alternative embodiment of the fabric substrate 150 having at least one encased yarn 158 extending in the warp direction W. FIG. 7 shows a cross-sectional view of the fabric substrate 150 along the fill direction F. The fabric substrate 150 can be a woven substrate that includes a first surface 152 and a second surface 154. The fabric substrate 150 can include a plurality of warp yarns 156 as well as at least one encased yarn 158 extending in the warp direction contained within a hollow channel 160.

The hollow channel 160 can be formed from a portion of the plurality of warp yarns 156 to define a first section 160A of the channel at the first surface 152 of the fabric substrate 150 and a second section 160B of the channel as the second surface 154 of the fabric substrate 150. The portion of the plurality of warp yarns 156 used to form the hollow channel 110 having sections 110A and 110B can range from 3 warp yarns to 30 warp yarns, such as from 4 warp yarns to 25 warp yarns, such as from 5 warp yarns to 20 warp yarns, such as from 6 warp yarns to 15 warp yarns. As shown, the plurality of warp yarns 156 and the at least one encased yarn 158 can be used as the warp yarns in the warp direction W that is transverse to the fill direction F.

Further, a plurality of fill yarns, such as, but not limited to, fill yarns 162 and 164, can travel in the fill direction F to define the first surface 152 and the second surface 154 and support the plurality of warp yarns 156 and the at least one encased yarn 158 in order to hold the shape of the fabric substrate 150. In the particular embodiment shown in FIG. 7, the plurality of fill yarns can include a first fill yarn 162 and a second fill yarn 164 that can be used in a repeating fashion. As also shown in FIG. 7, the at least one encased yarn 158 is an encased warp yarn.

In some embodiments, such as when the fabric substrate 150 is formed into a wearable product, the first surface 152 of the fabric substrate 150 can be the exterior-facing surface, while the second surface 154 can be the body-facing surface. Further, the fabric substrate 150 can include from about 10 picks per inch to about 100 picks per inch, such as from about 20 picks per inch to about 80 picks per inch, such as from about 30 picks per inch to about 70 picks per inch, where the unit of picks per inch refers to the number of fill or weft threads per inch of the woven fabric substrate 150. In addition, the fabric substrate 150 can include from about 10 ends per inch to about 100 ends per inch, such as from about 20 ends per inch to about 80 ends per inch, such as from about 30 ends per inch to about 70 ends per inch, where the unit of ends per inch refers to the number of warp threads per inch of the woven fabric substrate 150.

As described above, the fabric substrate 150 can include a plurality of conventional textile warp yarns 156 running in the warp direction W. In one embodiment, the plurality of warp yarns 156 can include synthetic fibers, such as non-aromatic polyamide fibers (nylon fibers), polyester fibers, polyolefin fibers such as polypropylene fibers, or a combination thereof. In another embodiment, the plurality of warp yarns 156 can be natural fibers such as cotton fibers. In another embodiment, the plurality of warp yarns 156 can be non-aromatic polyamide fibers, polyester fibers, polyolefin fibers, cotton fibers, or a combination thereof. Regardless of the particular fibers used to form the plurality of warp yarns 156, the plurality of warp yarns 156 can be selected to provide the desired aesthetics and tactile properties to the fabric substrate 150. In one particular embodiment, the plurality of warp yarns can have a linear density ranging from about 1 cotton count (Ne) to about 40 Ne, such as from about 4 Ne to about 30 Ne, such as from about 8 Ne to about 20 Ne. Further, the plurality of warp yarns 156 can each have a diameter D1 ranging from about 0.05 millimeters (mm) to about 1 mm, such as from about 0.075 mm to about 0.75 mm, such as from about 0.1 mm to about 0.5 mm.

In addition, the fabric substrate 150 can also include at least one encased yarn 158, such as an encased warp yarn 158 as shown in FIG. 7. The encased yarn 158 can be any type of yarn that includes a functional or electronic component or that provides structural or mechanical support to the fabric substrate 150 to achieve the desired properties. When the encased yarn 158 is a functional yarn that includes a functional or electronic component, such components can include a photonic device, a battery, color change, or a combination thereof. In one particular embodiment, the functional or electronic component can include one or more light emitting diodes (LEDs). In another embodiment, the functional component can include functional chemistry (e.g., a component that is capable of undergoing a color change, such as a thermochromic or photochromic component or material). In other embodiments, the encased warp yarn 158 can include a monofilament, a wire, or a specialty fiber that may need protection from damage as provided via the hollow channel 160. Further, it is to be understood that the encased yarn 158 can have any cross-sectional shape. For instance, in some embodiments, the functional yarn can be circular, oval, rectangular, square, triangular, hexagonal, etc. In one embodiment, the encased yarn 158 can have a diameter D2 ranging from about 0.15 mm to about 1.25 mm, such as from about 0.2 mm to about 1 mm, such as from about 0.25 mm to about 0.75 mm.

Further, because it can include functional or electronic components, or internal connective wires, the encased yarn 158 can be relatively stiff, resembling or even including a commercial monofilament yarn comprised of polyester or nylon. For example, the encased yarn 158 can exhibit a compressive resistance ranging from about 145 grams per square millimeter to about 155 grams per square millimeter, such as about 150 grams per square millimeter. Meanwhile, conventional textile fibers such as cotton that may be used in the plurality of warp yarns 156 can have a compressive resistance ranging from about 2.5 grams per square millimeter to about 10 grams per square millimeter, such as about 5 grams per square millimeter. To quantify compressive resistance, force is measured in grams, to linearly compress a 0.25 inch test specimen of fiber. The force value is then normalized according to the cross sectional area of the material. In the proposed embodiment, yarn 156 is flexible and easily compressed, while the encased yarn 108 is more resistant to compression. Therefore, if the overall fabric substrate 150 shrinks, expands, or is otherwise deformed, the at least one hollow channel 160 is present to protect the encased yarn 158 from damage that may result since it is typically formed from a stiffer material than the sections 166 of the fabric substrate 150 that are disposed between the hollow channels 160 and contain the plurality of warp yarns 156. Specific details of the at least one hollow channel 160 are discussed below.

As described above and as shown in FIG. 7, the hollow channel 160 can protect the encased yarn 158 disposed within it and can be formed from a portion of the plurality of warp yarns 156 to define a first section 160A of the channel at the first surface 152 of the fabric substrate 150 and a second section 1606 of the channel as the second surface 154 of the fabric substrate 150. The portion of the plurality of warp yarns 156 used to form the hollow channel 160 having sections 160A and 1606 can range from 3 warp yarns to 30 warp yarns, such as from 4 warp yarns to 25 warp yarns, such as from 5 warp yarns to 20 warp yarns, such as from 6 warp yarns to 15 warp yarns. The diameter D4 of the hollow channel 160 can be controlled such that is just slightly larger than the diameter D2 of the encased yarn 158 that it surrounds, or the diameter D4 can be substantially larger than the diameter D2 of the encased yarn 158 that it surrounds. In other words, the diameter D4 of the hollow channel 160 may be constructed to correspond with the diameter D2 of the encased yarn 158, such that encased yarn 158 is either tightly bound inside the channel 160 or loosely contained within the channel 160. For instance, the ratio of the diameter D4 of the hollow channel 160 to the diameter D2 of the encased yarn 158 can range from about 1.01 to about 20, such as from about 1.05 to about 15, such as from about 1.1 to about 10, such as from about 1.5 to about 5. In some embodiments, the difference in diameter between the hollow channel 160 diameter and the encased yarn 158 diameter is such that the encased yarn 158 is able to slip laterally (e.g., in the fill direction F) in relation to the sections 166 of the fabric substrate 150 that do not include the hollow channels 160 and form the base woven fabric. Such intentional slippage of the encased yarn 158 can further protect the encased yarn 158 from damage.

Figure 8:
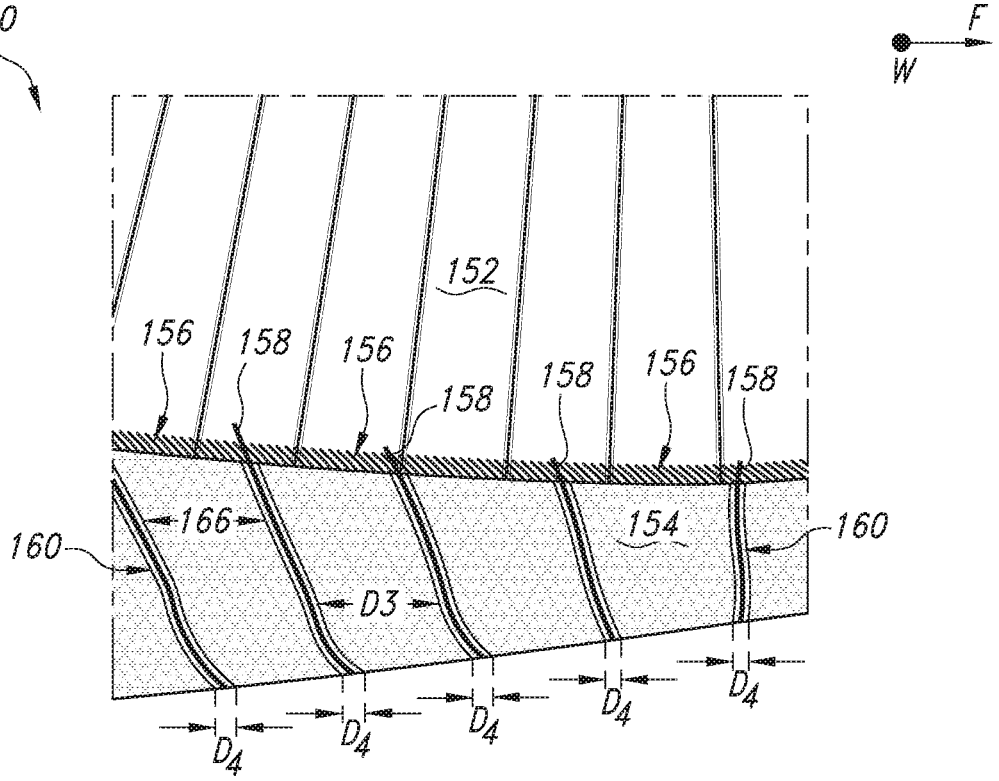
FIG. 8 is a photograph of the fabric substrate of FIG. 7 that includes multiple hollow channels, each for encasing a warp yarn, where the warp yarn within each hollow channel is undamaged due to any abrasion, bending, flexing, folding, compression, shrinkage, or expansion of the fabric substrate and remains undamaged after the fabric substrate is woven and subsequently handled or processed.

In addition, and referring to FIG. 8, when two or more hollow channels 160 are present in the fabric substrate 150, the portions of the fabric substrate 150 between adjacent hollow channels 160 (e.g., sections 166) can include normal woven textile fabric that is free of the hollow channels 160. Such sections 166 can span a distance D3 that is controlled based on purpose of the second encased yarn 158 contained within each of the hollow channels 160. It is also to be understood that in some embodiments, one or more of the hollow channels 160 may not contain a second encased yarn 158 and may instead be empty. In any event, the distance D3 between adjacent hollow channels 160 can range from about 2.5 millimeters to about 200 millimeters, such as from about 5 millimeters to about 150 millimeters, such as from about 10 millimeters to about 100 millimeters, such as from about 15 millimeters to about 75 millimeters.

Further, as part of the automated weaving process, the hollow channels 160 may be filled with the material to be encased and protected, such as photonic yarns, LED yarns, monofilament yarns, metallic wires, functional fibers, etc. referred to as the encased yarns 108.

As described above, the fabric substrate 150 can also include a plurality of fill yarns that run along the fill or weft direction F to maintain and hold the plurality of warp yarns 156 and the encased yarn 158 in their proper position within the fabric substrate 150 and that can define a first surface 152 and a second surface 154 of the fabric substrate 150. Although any suitable yarn or combination of yarns may be used for the fill yarns, such as fill yarns 162 and 164 as shown in FIG. 7, in one embodiment, the fill yarns can include a sheath and a core. For instance, the core can include a glass filament, a monofilament, carbon fibers, or polyester fibers, while the sheath can include non-aromatic polyamide fibers, polyester fibers, polyolefin fibers, cotton fibers, or a combination thereof.

Regardless of the particular material or materials used to form the fill yarns 162 and 164 of the fabric substrate 150, the fill yarns can have a linear density ranging from about 1 cotton count (Ne) to about 20 Ne, such as from about 2 Ne to about 15 Ne, such as from about 3 Ne to about 10 Ne. Further, the fill yarns can have a diameter ranging from about 0.05 mm to about 1.25 mm, such as from about 0.075 mm to about 1 mm, such as from about 0.1 mm to about 0.75 mm. Further, the plurality of fill yarns can each have a diameter ranging from about 0.05 millimeters (mm) to about 1 mm, such as from about 0.075 mm to about 0.75 mm, such as from about 0.1 mm to about 0.5 mm.

Figure 9:
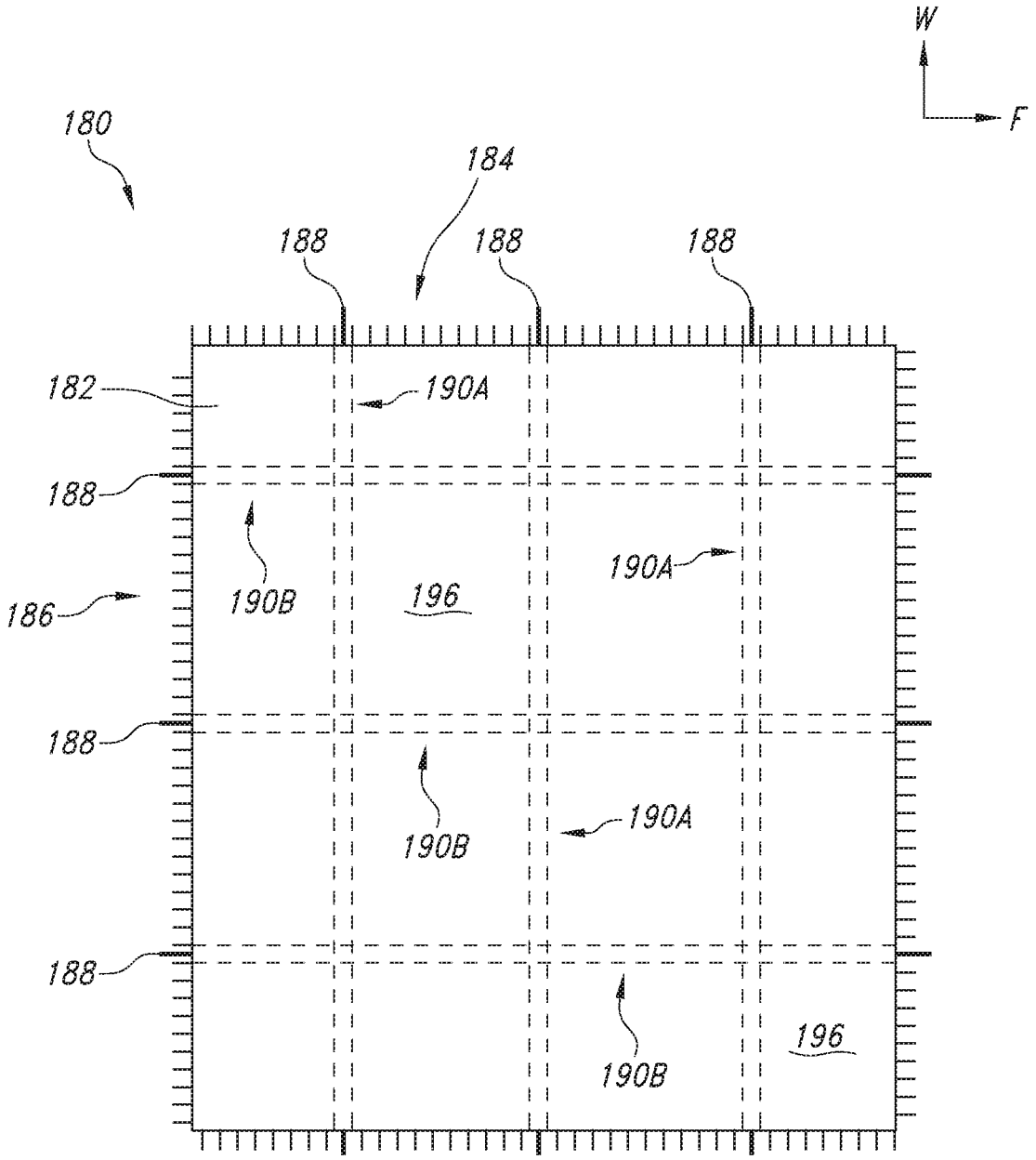
FIG. 9 is a top view of an alternative embodiment of a fabric substrate having hollow channels in both the warp direction and the fill direction.

In yet another embodiment, as illustrated in FIG. 9, a fabric substrate 180 can include at least one hollow channel 190A extending in the warp direction W and formed by a portion of a plurality of warp yarns 184, and at least one hollow channel 1906 extending in the fill or weft direction F and formed by a portion of a plurality of fill or weft yarns 186. As shown in FIG. 9, the hollow channels 190A and 1906 can surround encased yarns 188. The encased yarns 188 are encased within the hollow channels 190A and 1906 and are not visible on the top surface 182 of the fabric substrate 180 as illustrated in FIG. 9

In addition, the portions of the fabric substrate 180 between adjacent hollow channels 190A and 190B (e.g., sections 196) can include normal woven textile fabric that is free of the hollow channels 190A and 1906. Such sections 196 can span a distance that is controlled based on purpose of the encased yarn 188 contained within each of the hollow channels 190A and 190B. It is also to be understood that in some embodiments, one or more of the hollow channels 190A and 190B may not contain an encased yarn 188 and may instead be empty. In any event, the distance between adjacent hollow channels 190A and between adjacent hollow channels 190B can range from about 2.5 millimeters to about 200 millimeters, such as from about 5 millimeters to about 150 millimeters, such as from about 10 millimeters to about 100 millimeters, such as from about 15 millimeters to about 75 millimeters.

The fabric substrate 180 can include a plurality of conventional textile weft or fill yarns 186 running in the fill or weft direction F. In one embodiment, the plurality of fill yarns 186 can include synthetic fibers, such as non-aromatic polyamide fibers (nylon fibers), polyester fibers, polyolefin fibers such as polypropylene fibers, or a combination thereof. In another embodiment, the plurality of fill yarns 186 can be natural fibers such as cotton fibers. In another embodiment, the plurality of fill yarns 186 can be non-aromatic polyamide fibers, polyester fibers, polyolefin fibers, cotton fibers, or a combination thereof. In still another embodiment, the plurality of fill yarns can include a sheath and a core. For instance, the core can include a glass filament, a monofilament, carbon fibers, or polyester fibers, while the sheath can include non-aromatic polyamide fibers, polyester fibers, polyolefin fibers, cotton fibers, or a combination thereof. In another embodiment, the plurality of warp yarns 186 can be non-aromatic polyamide fibers, polyester fibers, polyolefin fibers, cotton fibers, or a combination thereof. Regardless of the particular fibers used to form the plurality of fill yarns 186, the plurality of fill yarns 186 can be selected to provide the desired aesthetics and tactile properties to the fabric substrate 180. In one particular embodiment, the plurality of fill yarns can have a linear density ranging from about 1 cotton count (Ne) to about 40 Ne, such as from about 4 Ne to about 30 Ne, such as from about 8 Ne to about 20 Ne. Further, the plurality of fill yarns can each have a diameter ranging from about 0.05 millimeters (mm) to about 1 mm, such as from about 0.075 mm to about 0.75 mm, such as from about 0.1 mm to about 0.5 mm.

The fabric substrate 180 can also include a plurality of warp yarns 184 that run along the warp direction W to maintain and hold the plurality of fill yarns in their proper position within the fabric substrate 180. Although any suitable yarn or combination of yarns may be used for the warp yarns 184, in one embodiment, the warp yarns can include a sheath and a core. For instance, the core can include a glass filament, a monofilament, carbon fibers, or polyester fibers, while the sheath can include non-aromatic polyamide fibers, polyester fibers, polyolefin fibers, cotton fibers, or a combination thereof. In another embodiment, the plurality of warp yarns 186 can be non-aromatic polyamide fibers, polyester fibers, polyolefin fibers, cotton fibers, or a combination thereof. Regardless of the particular material or materials used to form the warp yarns 184 of the fabric substrate 180, the warp yarns can have a linear density ranging from about 1 cotton count (Ne) to about 20 Ne, such as from about 2 Ne to about 15 Ne, such as from about 3 Ne to about 10 Ne. Further, the warp yarns can have a diameter ranging from about 0.05 mm to about 1.25 mm, such as from about 0.075 mm to about 1 mm, such as from about 0.1 mm to about 0.75 mm.

Further, it is to be understood that although not repeated in detail with respect to FIGS. 7-9, any of the various features described above with respect to fabric substrate 100 may also be incorporated into fabric substrate 150 and fabric substrate 180 to the extent that such features do not conflict with the features required by the fabric substrate 150 and fabric substrate 180, respectively.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A fabric substrate having a warp direction and a fill direction, the fabric substrate comprising a plurality of warp yarns, and a plurality of fill yarns, wherein the plurality of warp yarns comprises a first surface and a second surface, wherein the plurality of fill yarns are inserted between the first surface and the second surface of the plurality of warp yarns to define a single layer, wherein a portion of the plurality of fill yarns form a hollow channel extending in the fill direction, wherein the hollow channel contains an encased fill yarn, wherein the hollow channel comprises a first section formed by the first surface of the plurality of warp yarns and a second section formed by the second surface of the plurality of warp yarns, wherein the first section and second section define a double layer of the plurality of warp yarns between which the encased fill yarn is inserted, and wherein a ratio of a diameter of the hollow channel to a diameter of the encased fill yarn ranges from 1.05 to about 20 to allow for intentional slippage of the encased fill yarn.

2. A fabric substrate as defined in claim 1, wherein the encased fill yarn comprises a functional yarn, a monofilament yarn, or a wire.

3. A fabric substrate as defined in claim 2, wherein the functional yarn contains a functional or electronic component, or functional chemistry.

4. A fabric substrate as defined in claim 3, wherein the functional or electronic component comprises a photonic device, a battery, light emitting diode, or a combination thereof.

5. A fabric substrate as defined in claim 2, wherein the monofilament is nylon, polyethylene, ultrahigh molecular weight polyethylene, polyvinylidene fluoride, polyester, or a combination thereof.

6. A fabric substrate as defined in claim 2, wherein the wire comprises a metal.

7. A fabric substrate as defined in claim 1, wherein the encased fill yarn has a diameter ranging from about 0.15 millimeters to about 1.25 millimeters.

8. A fabric substrate as defined in claim 1, wherein the plurality of fill yarns each have a diameter ranging from about 0.05 millimeters to about 1 millimeter.

9. A fabric substrate as defined in claim 1, wherein the plurality of fill yarns each comprise non-aromatic polyamide fibers, polyester fibers, polyolefin fibers, cotton fibers, or a combination thereof.

10. A fabric substrate as defined in claim 1, wherein the portion of the plurality of fill yarns forming the hollow channel includes from 3 yarns to 30 yarns.

11. A fabric substrate as defined in claim 1, wherein the fabric substrate comprises at least one additional hollow channel adjacent the hollow channel.

12. A fabric substrate as defined in claim 11, wherein the at least one additional hollow channel contains an additional encased fill yarn.

13. A fabric substrate as defined in claim 11, wherein the hollow channel and the at least one additional hollow channel are separated by a distance in the warp direction ranging from about 2.5 millimeters to about 200 millimeters.

14. A fabric substrate as defined in claim 1, wherein the plurality of warp yarns each have a diameter ranging from about 0.05 millimeters to about 1 millimeter.

15. A fabric substrate as defined in claim 14, wherein each of the plurality of warp yarns comprises a sheath and a core.

16. A fabric substrate as defined in claim 15, wherein the sheath comprises non-aromatic polyamide fibers, polyester fibers, polyolefin fibers, cotton fibers, or a combination thereof, and wherein the core comprises a glass filament, a monofilament, carbon fibers, or polyester fibers.

17. A fabric substrate as defined in claim 1, wherein a portion of the plurality of the warp yarns form a hollow channel extending in the warp direction, wherein the hollow channel contains an encased warp yarn.

18. A fabric product comprising the fabric substrate defined in claim 1.

19. The fabric product as defined in claim 17, wherein the fabric product is an item of apparel.

20. The fabric product as defined in claim 17, wherein the fabric product is a protective, automotive, industrial, medical, construction, or carpeting product.

21. A fabric substrate having a warp direction and a fill direction, the fabric substrate comprising a plurality of warp yarns, and a plurality of fill yarns, wherein the plurality of fill yarns comprises a first surface and a second surface, wherein the plurality of warp yarns are inserted between the first surface and the second surface of the plurality of fill yarns to define a single layer, wherein a portion of the plurality of warp yarns form a hollow channel extending in the warp direction, wherein the hollow channel contains an encased warp yarn, wherein the hollow channel comprises a first section formed by the first surface of the plurality of fill yarns and a second section formed by the second surface of the plurality of fill yarns, wherein the first section and second section define a double layer of the plurality of fill yarns between which the encased warp yarn is inserted, wherein a ratio of a diameter of the hollow channel to a diameter of the encased warp yarn ranges from 1.05 to about 20 to allow for intentional slippage of the encased warp yarn.

22. A fabric substrate as defined in claim 21, wherein the encased warp yarn comprises a functional yarn, a monofilament yarn, or a wire.

23. A fabric substrate as defined in claim 22, wherein the functional yarn contains a functional or electronic component, or functional chemistry.

24. A fabric substrate as defined in claim 23, wherein the functional or electronic component comprises a photonic device, a battery, light emitting diode, or a combination thereof.

25. A fabric substrate as defined in claim 22, wherein the monofilament is nylon, polyethylene, ultrahigh molecular weight polyethylene, polyvinylidene fluoride, polyester, or a combination thereof.

26. A fabric substrate as defined in claim 22, wherein the wire comprises a metal.

27. A fabric substrate as defined in claim 21, wherein the encased warp yarn has a diameter ranging from about 0.15 millimeters to about 1.25 millimeters.

28. A fabric substrate as defined in claim 21, wherein the plurality of warp yarns each have a diameter ranging from about 0.05 millimeters to about 1 millimeter.

29. A fabric substrate as defined in claim 21, wherein the plurality of warp yarns each comprise non-aromatic polyamide fibers, polyester fibers, polyolefin fibers, cotton fibers, or a combination thereof.

30. A fabric substrate as defined in claim 21, wherein the portion of the plurality of warp yarns forming the hollow channel includes from 3 yarns to 30 yarns.

31. A fabric substrate as defined in claim 21, wherein the fabric substrate comprises at least one additional hollow channel adjacent the hollow channel.

32. A fabric substrate as defined in claim 31, wherein the at least one additional hollow channel contains an additional encased warp yarn.

33. A fabric substrate as defined in claim 31, wherein the hollow channel and the at least on additional hollow channel are separated by a distance in the fill direction ranging from about 2.5 millimeters to about 200 millimeters.

34. A fabric substrate as defined in claim 21, wherein the plurality of fill yarns each have a diameter ranging from about 0.05 millimeters to about 1 millimeter.

35. A fabric substrate as defined in claim 34, wherein each of the plurality of fill yarns comprises a sheath and a core.

36. A fabric substrate as defined in claim 35, wherein the sheath comprises non-aromatic polyamide fibers, polyester fibers, polyolefin fibers, cotton fibers, or a combination thereof, and wherein the core comprises a glass filament, a monofilament, carbon fibers, or polyester fibers.

37. A fabric substrate as defined in claim 21, wherein a portion of the plurality of the fill yarns form a hollow channel extending in the fill direction, wherein the hollow channel contains an encased fill yarn.

38. A fabric product comprising the fabric substrate defined in claim 21.

39. The fabric product as defined in claim 38, wherein the fabric product is an item of apparel.

40. The fabric product as defined in claim 38, wherein the fabric product is a protective, automotive, industrial, medical, construction, or carpeting product.

* * * * *